United States Patent [19]

Hejlesen

[11] Patent Number: 5,050,651

[45] Date of Patent: Sep. 24, 1991

[54] APPARATUS FOR THE OPENING AND SEPARATING OF VALVE BAGS

[75] Inventor: Christian Hejlesen, Aalborg, Denmark

[73] Assignee: Bates Ventil Saekke Co. A/S, Norresundby, Denmark

[21] Appl. No.: 558,778

[22] Filed: Jul. 26, 1990

[51] Int. Cl.[5] ..... B65B 1/04; B67C 3/00

[52] U.S. Cl. ..... 141/314; 53/573; 53/385.1; 141/114; 141/68; 141/166

[58] Field of Search ..... 141/114, 68, 166, 315, 141/314; 53/571, 573, 385.1

[56] References Cited

U.S. PATENT DOCUMENTS

| | | | |
|---|---|---|---|
| 2,182,187 | 12/1939 | Wagner | 53/573 |
| 3,044,231 | 7/1962 | Blais et al. | 53/571 |
| 3,421,287 | 1/1969 | Sheets | 53/573 |
| 3,989,073 | 11/1976 | Remmert | 141/315 |
| 4,019,546 | 4/1977 | Hastrup | 141/114 |
| 4,158,943 | 6/1979 | Lack et al. | 53/571 |
| 4,873,816 | 10/1981 | Mitlebach | 53/573 |

*Primary Examiner*—Henry J. Recla
*Assistant Examiner*—Keith Kuptebchmid
*Attorney, Agent, or Firm*—Darby & Darby

[57] ABSTRACT

An apparatus for opening the upper and lower surfaces of a flat-folded valve bag and for separating a valve bag from a stack of valve bags includes a wedge-shaped insertion member comprising two movable parts mounted on a movable carriage. The movable parts are inserted into the valve and splayed to separate the valve. The carriage moves the insertion member and valve bag upward to separate the bag from a stack of bags. The apparatus also includes a device for depressing the bags and an air blower which directs air along the upper surface of the valve to open the valve for insertion of the insertion member.

5 Claims, 4 Drawing Sheets

APPARATUS FOR THE OPENING AND SEPARATING OF VALVE BAGS

Valve bags are widely used for packing granular, pelletized, or powdery goods as seed, cement, artificial fertilizers, animal foodstuffs etc., as the inlet valve in the bag provides the opportunity for automatic filling of the bag by filling machine. Also, the handling of the bag i.e. the picking-up of the bag and placing it on the filling spout of the filling machine may be automated more or less.

Such an apparatus for the mounting of valve bag on filling spout may comprise a wedge-shaped or beak-like insertion member comprising two mutually movable parts. While the valve is in a closed or folded state, the insertion member is inserted into the valve, the wedge-shape of the insertion member facilitating the entering of the member into the mouth of the valve. After that the parts of the member are splayed so that the valve is distended whereupon a gripping member holds around the valve while the insertion member is removed from the valve bag.

In practical use the apparatus picks up the uppermost valve bag from a stack, which is the first part of the process of filling the bags. It is therefore important that the picking-up of the bags proceeds without interruption as any irregularities are time-consuming and implies extra costs to the filling process. Such irregularities are likely to occur at the time when the insertion member is about to engage the mouth of the valve, since the accessible aperture of the valve in its flat-folded state is small why the valve might not be engaged by the insertion member. Also, in some types of valve bags the valve may have a extra layer of bag material e.g. paper layer that is discontinued just outside the mouth of the valve causing the insertion member to be caught by this edge when entering the mouth as the member glides towards the mouth along a lower, upward-facing surface of the bag.

An object of the present invention is to provide an apparatus for the mounting of valve bags on a filling spout.

Another object of the present invention is to provide means for secure engagement of a valve in a valve bag by an insertion member.

A further object of the invention is to provide means for increasing the aperture of the mouth of a flat-folded valve in a valve bag immediately before inserting an insertion member into the valve.

A further object of the invention is to provide means for avoiding that a forward part of an insertion member is caught by unevennesses in a surface of a valve bag as the insertion member slides along the surface.

A further object of the invention is to provide means for depressing a part of the valve bag near the valve's mouth while the insertion member is moved into the mouth.

A further object of the invention is to provide means for lifting up an upper sidepiece of a flat-folded valve in a valve bag.

A preferred embodiment of the apparatus according to the invention is described hereinafter with reference to the drawings.

Figure 3A:
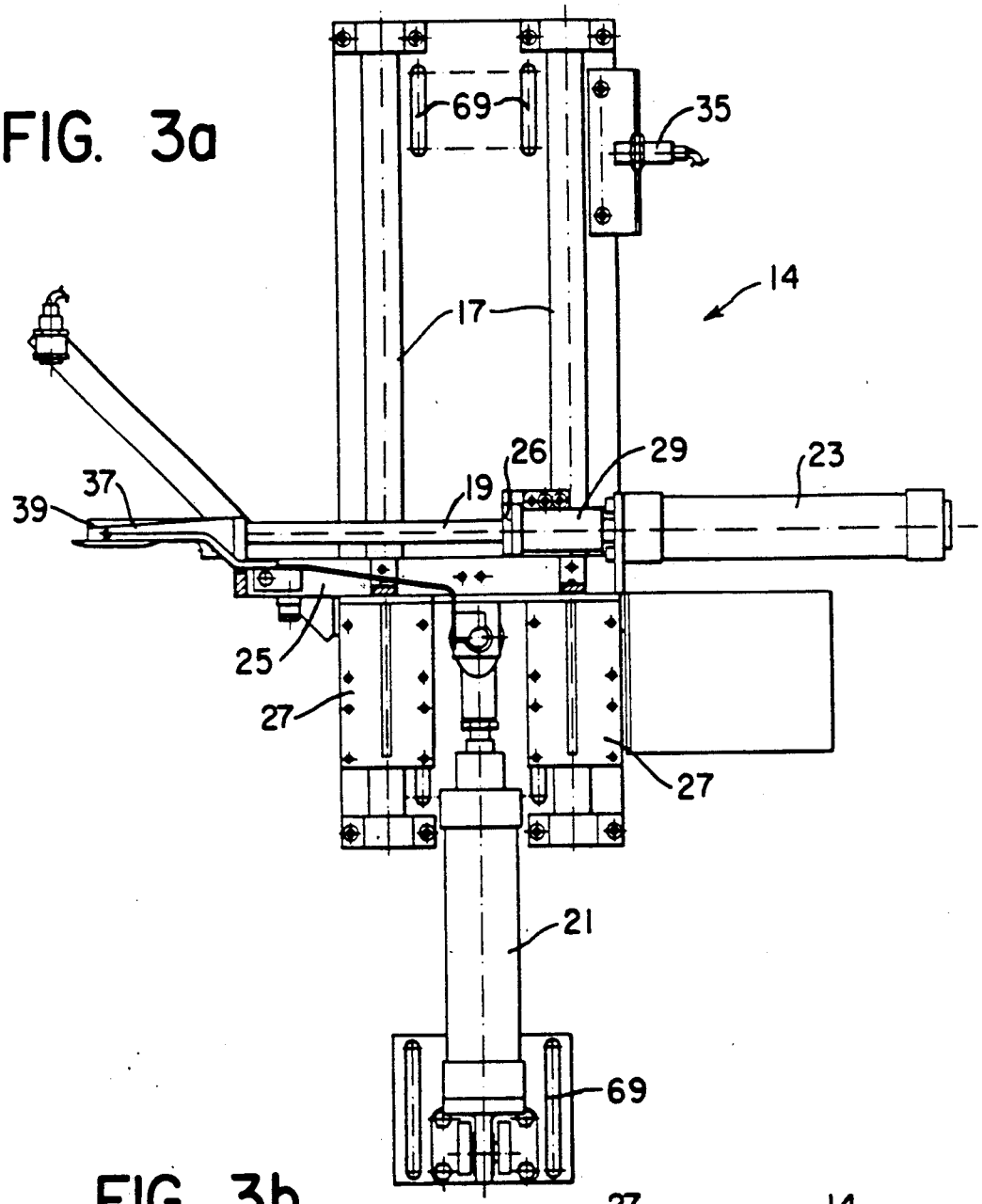
Figure 3B:
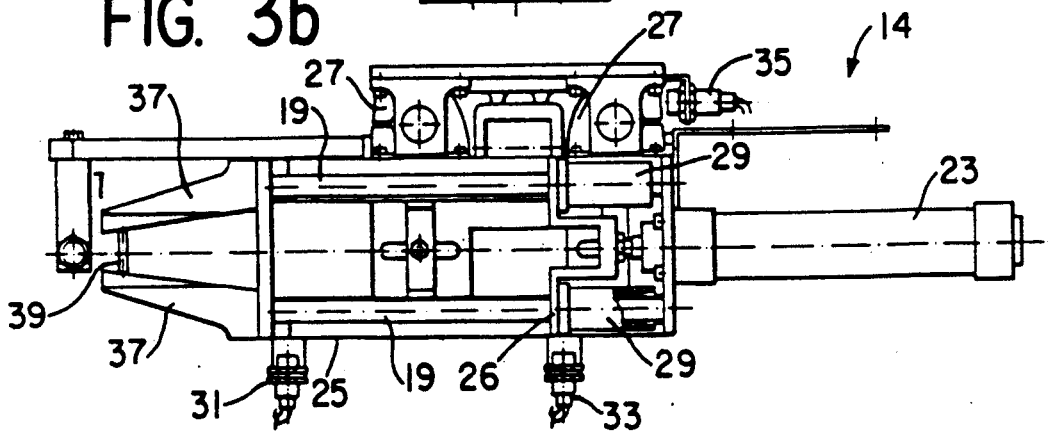

FIG. 3*a* and 3*b* shows enlarged detailed view of a carriage part for an insertion member in a side view and an elevated view.

Figure 4A:
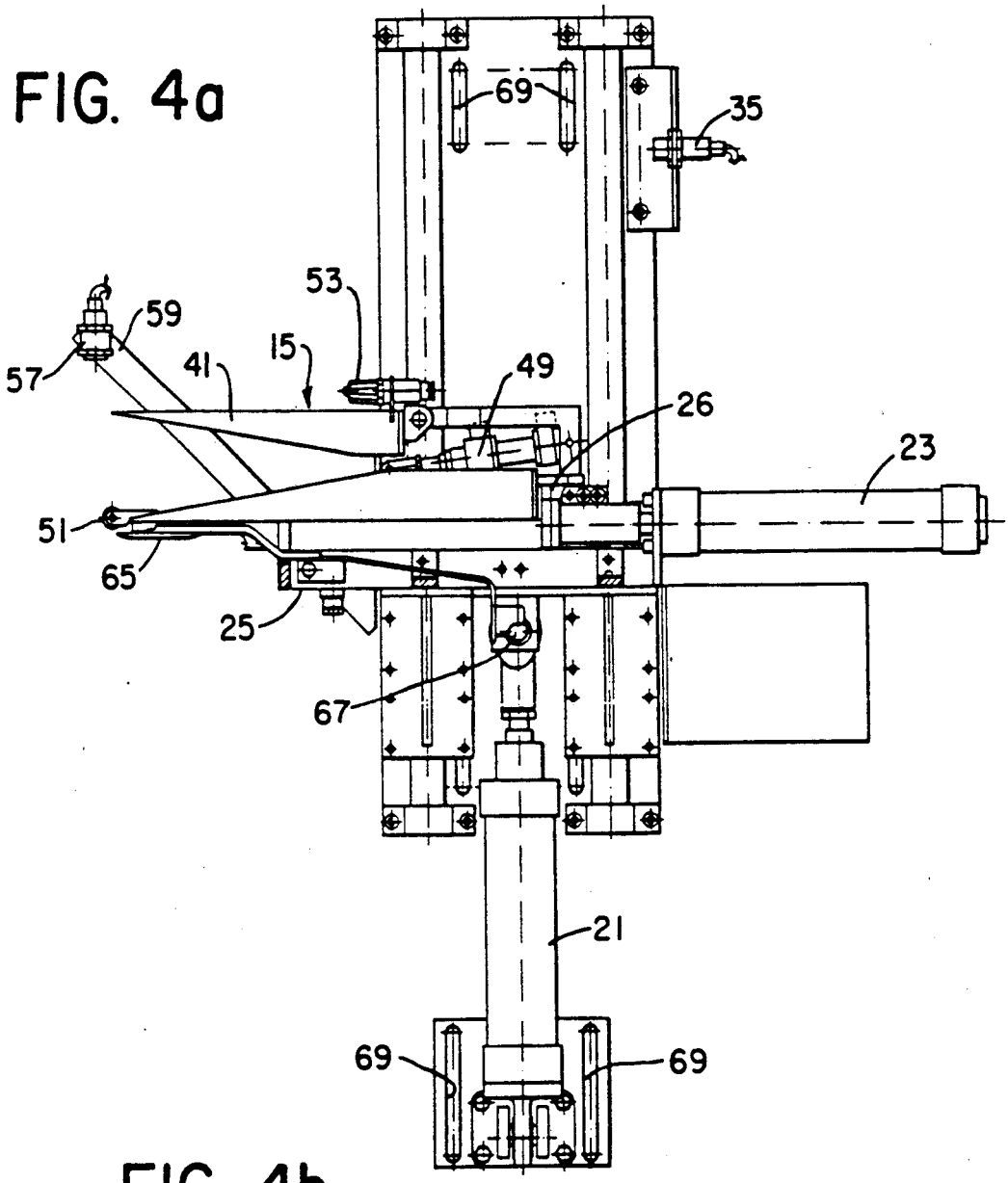
Figure 4B:
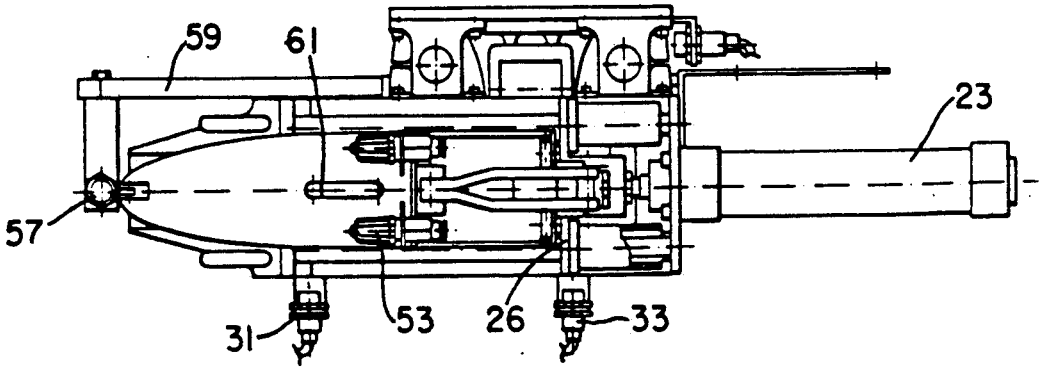

FIG. 4*a* and 4*b* shows views similar to 3*a* and 3*b* but mounted with an insertion member.

Figure 5C:
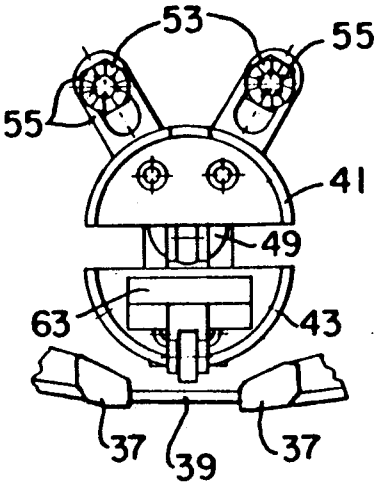
Figure 5A:
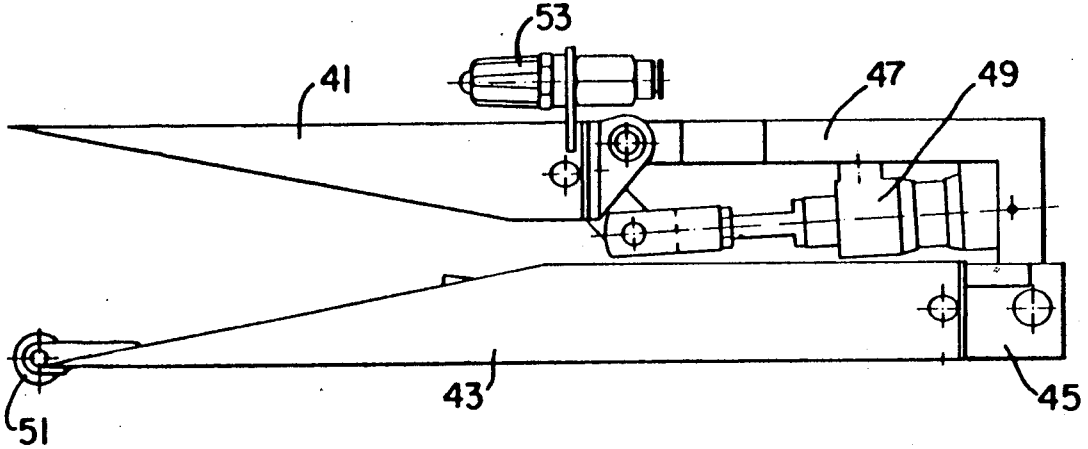
Figure 5B:
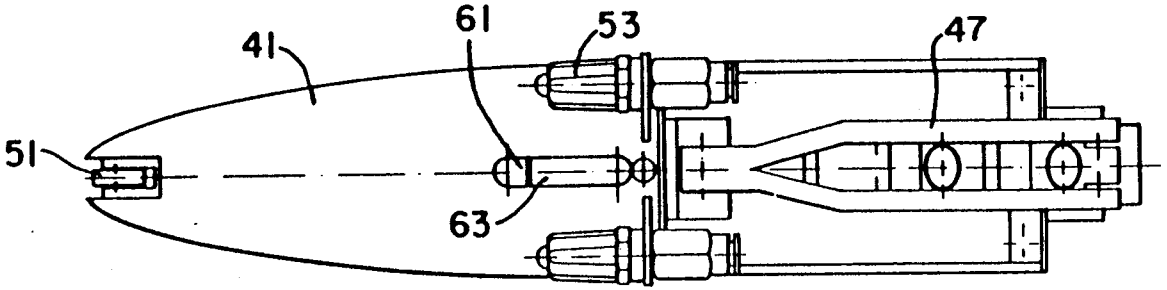

FIG. 5*a*, 5*b* and 5*c* shows different enlarged views of the insertion member.

Figure 1:
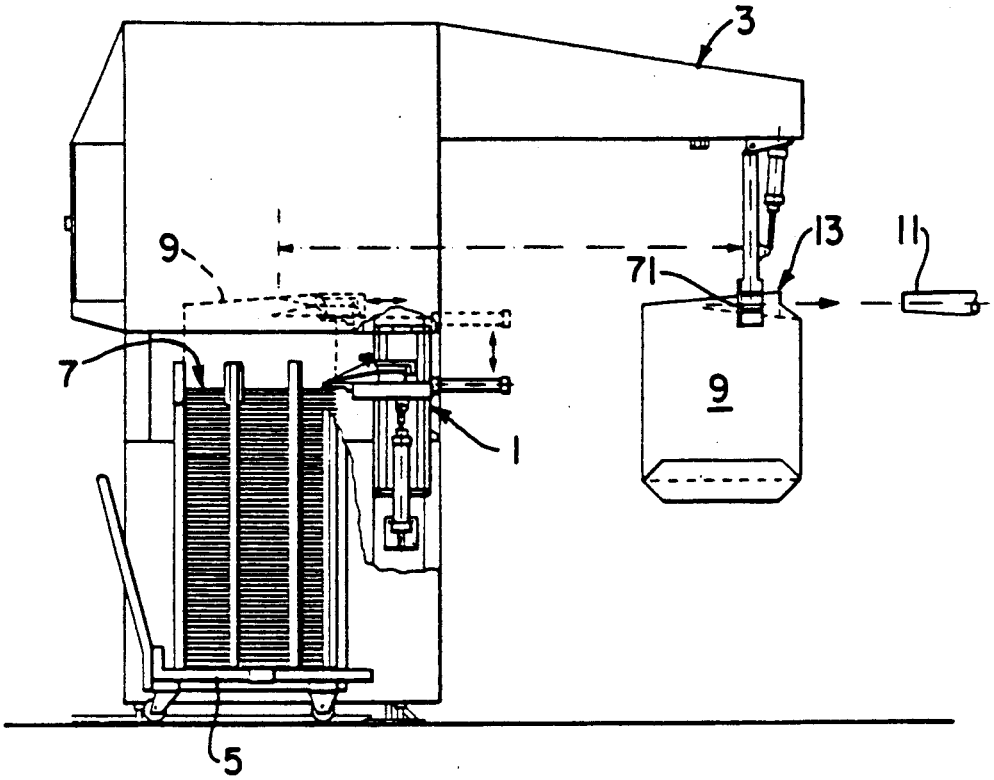
FIG. 1 shows an embodiment of an apparatus according to the invention in a side view.
Figure 2:
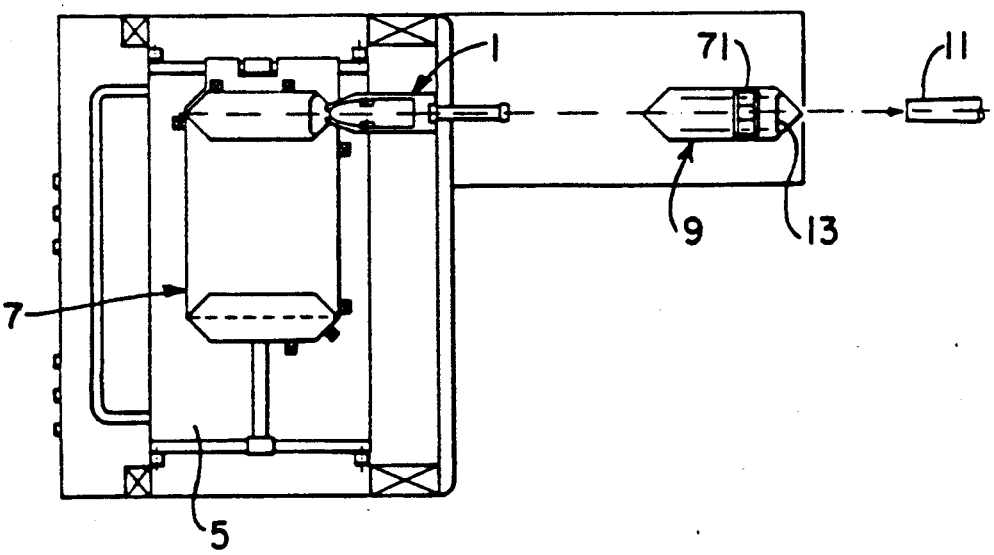
FIG. 2 shows the same as FIG. 1 but in an elevated sectional view.

A preferred embodiment of an apparatus according to the invention is shown on FIG. 1 and 2. The apparatus comprises a pick-up unit 1, a gripping unit 3 and a trolley 5 holding a stack 7 of valve bags 9. The apparatus includes not shown control unit and supply of pressurized air, the provision of these means being well known to the skilled in the art.

When using the apparatus a bag 9 is picked up by the unit 1, whereafter the gripping unit 3 closes around the bag's opened valve 13 and the bag 9 is moved to a filling spout 11 where the bag 9 is held during the filling process by not shown holding means.

The pick-up unit 1 consists of a carriage part 14 as shown on FIG. 3*a* and 3*b* on which the insertion member 15 may be mounted as shown on FIGS. 4*a* and 4*b*. The carriage part 14 comprises vertical guiding means 17 and horizontal guiding means 19 along which the insertion member 15 attached to a vertical carriage element 25 and a horizontal carriage element 26 may be displaced by a pneumatic cylinders 21 and 23, respectively. The guiding means consist preferably of cylindrical rods on which the carriage elements 25 and 26 may slide on bearings 27 and 29.

The position of carriage elements 25 and 26 are controlled via optical sensors 31, 33 and 35, which in a way known to the skilled in the art may transmit electric signals to the controlling unit according to the immediate position of the elements 25 and 26.

At the end of the guiding means 19 pointing in the direction of the inserting movement there is provided depressing means consisting of two finger-like bars 37 that are tapered towards their free ends. The bars 37 are interconnected by a rod 39 for the sake of mechanical stability of the bars 37 during operation.

When assembled the pick-up unit 1 may appear as shown on FIGS. 4*a* and 4*b*. The insertion member 15 as shown in detail on FIGS. 5*a*–5*c* is preferably made of an upper part 41 and a lower part 43 each consisting of a part-cylindrical shell tapered to one end. The lower part 43 is fixed to a base member 45 while the upper part 41 is pivotably attached to a strut 47 of the base member 45. An pneumatic cylinder 49 attached to the upper part 41 and base member 45, respectively, may control the upper part 43 between an inserting position shown left on FIG. 1 and an extended position shown on FIGS. 4*a* and 5*a*.

At its inserting or pointed end the lower part 43 is furnished with a roller member 51 that is rotatably mounted along a horizontal axis. The upper part 41 is furnished with two air nozzles 53 at its upward-facing side, the nozzles 53 being connected with the controlling unit and the pressurized air supply. Each nozzle 53 is preferably furnished with several air outlets 55 that are positioned circularly and pointing in the inserting direction of the member 15. Thereby a smooth flow of air may be provided in the inserting direction with only small noise.

On the vertically-displaceable element 25 of the carriage 14 a light-emitting sensor 57 is provided at the end of an arm 59. For use in this connection a slot 61 is provided in the upper part 41 and a light-reflecting member 63 is placed below the slot 61 and fixed to the lower part 43. When the insertion member 15 is displaced in horizontal direction to its extreme position for insertion into a valve a light ray emitted from the sensor 57 may pass through the slot 61 and be reflected back to the sensor 57 by the member 63 in which case an electric signal may be conveyed to the controlling unit indicating that the valve of the valve bag 9 has been missed.

The bars 37 extends along the downward-facing side of the lower part 43 of the insertion member 15. As seen on FIG. 5c, the bars 37 each have a cross-sectional shape that on the upward- and inward-facing sides is suited to lie below the lower part 43 of the insertion member 15 and that on the outward/downward-facing sides by chamfering is suited to fit in an open valve of a valve bag.

Attached to the carrying element 25 there is provided a sensor of the type with a contact lever 65 that is in connection with a switch 67. The switch 67 is thereby able to give an electric signal to the controlling unit when the lever 65 touches e.g. the uppermost bag 9 in a stack 7.

The carriage means 14 is fastened to the apparatus by not shown screws through slots 69.

The apparatus according to the invention functions as follows.

The apparatus is fed with a stack 7 of paper valve bags 9. In the work cycle of the apparatus the process is started either by activating the control unit as such, or the control unit is just continuing according to its preprogrammed instructions. The insertion member 15 is closed in its initial position, forming the wedge-shaped configuration as shown on the left of FIG. 1, and the cylinder 21 moves the carriage element 25 downwards in line with the position of the valves of the bags 9, until lever 65 is forced upwards by the uppermost bag 9 in the stack 7 and the signal from switch 67 stops the downward movement. At this moment depressing means 37 firmly pushes on the upper bag 9 at an area in front of the mouth of the bag's valve. Thereby the part opposite this area inside the valve is also depressed forming a slightly increased aperture in the otherwise flat-folded valve. At this moment the control unit feeds the nozzles 53 with pressurized air resulting in an air flow along the uppermost face of the valve, which air flow analogous with the aeroplane wings creates a subpressure at this uppermost side of the valve. The upper side of the valve is lifted, further increasing the said aperture of the mouth. Then the cylinder 23 is activated by the control unit, pushing the carrying element 26 with the insertion member 15 towards the mouth of the valve while the roller member 51 rolls on the bag's aforementioned area while the bars 37 are not moving. The roller member 5 thereby further depresses the lower side of the valve, increasing the aperture of the mouth of the valve. Any edges, creases, etc. on the underlying surface that otherwise might catch the inserting end of the inserting member 15 are thereby avoided. Upon the full extension of the cylinder 23 the sensor 57 controls correct fitting of the valve around the member 15. If positive, the control unit causes activation of cylinder 49 that pivots the upper part 41, thereby distending the valve to the state shown by reference number 13. After that cylinder 21 moves the carriage element 25 upwards lifting the bag 9 now held by the insertion member 15. The gripping unit 3, which is described in GB patent specification No. 2 078 189 which hereby is introduced by reference, is then activated and the claw 71 is displaced to the position of the insertion member 15 as shown with broken lines on FIG. 1. The bag 9 with distended valve 13 as shown i the right side of FIGS. 1 and 2 is then moved to a filling spout 11.

Other embodiments of the invention than the abovementioned are possible within the scope of the claims. For example the apparatus may have other ways of feeding bags.

I claim:

1. Apparatus for opening upper and lower surfaces of a flat-folded valve of a valve bag and separating a valve bag from a stack of valve bags comprising a wedge-shaped insertion member having two separate mutually movable parts, each of said movable parts having a distal inserting end and a proximal end, said insertion member being supported at each of said proximal ends by carriage means which cooperates with said insertion member to move the inserting ends of the insertion member into a flat-folded valve of a valve bag; means for distending said upper and lower surfaces of said valve by the mutual movement away from each other of the said movable parts; attached to roller means attached to the inserting end of one of the movable parts of the insertion member to assist the inserting end to roll on the lower surface of said valve; and means for moving said carriage means to separate the valve bags from a stack of valve bags.

2. Apparatus according to claim 1 wherein at least one means for depressing a lower part of said valve are attached to said carriage means.

3. Apparatus according to claim 2 wherein said depressing means consist of two finger-like bars that extend along a downward-facing side of the insertion member, the insertion member being displaceable in a mainly horizontal direction relatively to the said bars.

4. Apparatus according to claim 1 wherein the insertion member is provided with means for directing an air flow toward and along an upper surface of the said valve.

5. Apparatus according to claim 4 wherein the means for directing air flow consist of at least one nozzle, each nozzle having several air discharge outlets.

* * * * *